US009333615B1

(12) United States Patent
Johnson

(10) Patent No.: US 9,333,615 B1
(45) Date of Patent: May 10, 2016

(54) APPARATUS FOR MOUNTING ONE OR MORE ORBITAL SANDERS HAVING AN EXTENDED HANDLE

(71) Applicant: Kenneth Johnson, Aspen, CO (US)

(72) Inventor: Kenneth Johnson, Aspen, CO (US)

( * ) Notice: Subject to any disclaimer, the term of this patent is extended or adjusted under 35 U.S.C. 154(b) by 0 days.

(21) Appl. No.: 14/629,972

(22) Filed: Feb. 24, 2015

(51) Int. Cl.
*B24B 23/02* (2006.01)
*B24B 23/04* (2006.01)
*B24B 7/18* (2006.01)
*B24B 23/00* (2006.01)

(52) U.S. Cl.
CPC . *B24B 7/18* (2013.01); *B24B 7/184* (2013.01); *B24B 7/186* (2013.01); *B24B 23/005* (2013.01)

(58) Field of Classification Search
CPC ..... B24B 23/00; B24B 23/02; B24B 23/04; B24B 23/005; B24B 7/18; B24B 7/182; B24B 7/184; B24B 7/186
USPC ..... 451/350, 353, 357, 360
See application file for complete search history.

(56) References Cited

U.S. PATENT DOCUMENTS 1,550,102 A * 8/1925 Schlueter ..... B24B 7/18 15/49.1
1,763,365 A * 6/1930 Nobbs ..... A47L 11/162 15/363
2,251,442 A * 8/1941 Emmons ..... B24B 23/02 29/DIG. 79
2,691,256 A * 10/1954 Schmitt ..... B24B 7/186 451/351
2,702,395 A * 2/1955 Zaiger ..... A47L 11/162 15/144.4
4,685,252 A 8/1987 Ponce
4,703,589 A 11/1987 Ponce
4,719,659 A * 1/1988 Urakami ..... A47L 11/16 15/49.1
6,053,805 A 4/2000 Sanchez
6,793,568 B2 9/2004 Dotta
7,189,154 B1 3/2007 Karppinen
7,261,623 B1 * 8/2007 Palushi ..... B24B 7/186 451/350
7,275,981 B1 10/2007 Hurt
7,416,477 B2 8/2008 Henke
7,740,524 B2 * 6/2010 Ray, Jr. ..... B24D 15/00 451/354
7,771,253 B2 8/2010 Wuensch
7,997,961 B1 8/2011 De La Rosa
8,206,200 B2 6/2012 Stott
8,282,445 B2 * 10/2012 Goldberg ..... A47L 11/16 451/350
8,393,937 B2 * 3/2013 Goldberg ..... B24B 7/186 451/350
2004/0147209 A1 7/2004 Bickford
2006/0073777 A1 * 4/2006 Dotta ..... B24B 23/00 451/354
2007/0184762 A1 * 8/2007 Dummermuth-Furter ..... B24B 41/047 451/353

(Continued)

FOREIGN PATENT DOCUMENTS

EP 1702715 B1 11/2012
JP 2010023132 A 2/2010
WO WO2005075147 A1 8/2005

*Primary Examiner* — Eileen Morgan
(74) *Attorney, Agent, or Firm* — Leyendecker & Lemire, LLC

(57) ABSTRACT

An apparatus for mounting one or two handheld type orbital thereto is described to permit a user to sand a floor surface from a standing position while moving the mounted sander(s) to and fro by way of a broom handle extending from the apparatus. Typically, the apparatus includes one fixed mount and one moveable mount. Each mount is configured to facilitate attachment to an orbital sander. The moveable mount can be placed and secured in one of two positions: A first position that centers a single sander in line with the handle and a second position wherein the fixed mount is located to one side of the handle and the moveable mount is secured essentially an equal distance on the other side of the handle.

19 Claims, 4 Drawing Sheets

(56) References Cited

U.S. PATENT DOCUMENTS

2008/0230939 A1* 9/2008 Ali ..... B24D 15/04 264/46.4
2008/0233849 A1* 9/2008 Ali ..... B24D 15/04 451/525
2009/0019652 A1* 1/2009 Goldberg ..... A47L 11/16 15/49.1
2009/0023369 A1* 1/2009 Thysell ..... B24B 41/047 451/350
2009/0181607 A1* 7/2009 Ray, Jr. ..... B24D 15/00 451/523
2010/0190421 A1* 7/2010 Hamm ..... B24B 41/047 451/353
2010/0197210 A1* 8/2010 Goldberg ..... B24B 7/186 451/353
2010/0291843 A1* 11/2010 Strickland ..... A47L 11/16 451/350
2013/0084782 A1* 4/2013 McCutchen ..... B24B 7/186 451/28
2014/0154959 A1* 6/2014 Van Der Veen ..... B24B 7/18 451/350
2014/0173864 A1* 6/2014 Hamm ..... B24D 13/142 29/90.01
2014/0369019 A1* 12/2014 Sabia ..... B24B 23/005 361/828
2015/0239088 A1* 8/2015 Wisenbaker ..... B24B 23/005 451/353

* cited by examiner

APPARATUS FOR MOUNTING ONE OR MORE ORBITAL SANDERS HAVING AN EXTENDED HANDLE

BACKGROUND

On Occasion, it may become necessary to sand a wood deck floor prior to restaining: the surface of the wood may have become weathered, oxidized and/or uneven. Similarly, over time the surfaces of an interior wood floor especially the surface coating can become worn through use and require refinishing. To ensure a new coating adheres properly to the wood often necessitates removal of the old coating.

Traditionally, special purpose floor sanders have been used to remove the top layer of a deck or interior wood floor. Floor sanders are relatively expensive and do not represent a practical purchase for most homeowners who might otherwise desire to re-finish their decks and wood floor themselves. While floor sanders can sometimes be rented through equipment rental facilities, they are typically very powerful and as a consequence difficult for those without experience. Errors in sanding the floor can cause divots, unevenness and/or the removal of too much wood: all of which could ruin the floor and necessitate very costly replacement.

For small areas, a small hand held orbital sander can be used to sand a deck or wood floor; however, for larger areas the amount of time a user must toil on his/her hands and knees becomes significant and can cause great discomfort. Furthermore, the power and consequently material removal rate of a single hand held orbital sander is relatively low especially compared to a commercial floor sander making it impractical for use on all but small square footage applications.

DETAILED DESCRIPTION

Figure 1:
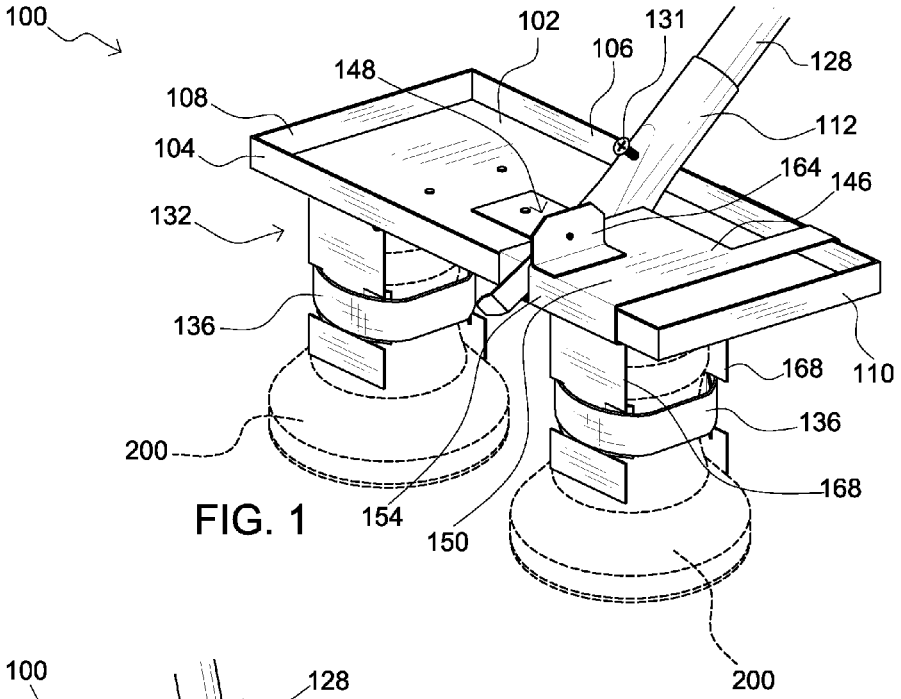
FIG. 1 is an isometric front/side view of the mounting apparatus with dual orbital sanders attached thereto according to one embodiment of the present invention.

Embodiments of the present invention comprise an apparatus for mounting one or two handheld type orbital thereto to permit a user to sand a floor surface from a standing position while moving the mounted sander(s) to and fro by way of a broom handle (or similar elongated pole) extending from the apparatus. Typically, the apparatus includes one fixed mount and one moveable mount. Each mount is configured to facilitate attachment to an orbital sander. The moveable mount can be placed and secured in one of two positions: A first position that centers a single sander in line with the handle and a second position wherein the fixed mount is located to one side of the handle and the moveable mount is secured essentially an equal distance on the other side of the handle. Advantageously, for larger jobs two sanders can be used simultaneously wherein for smaller jobs, perhaps where greater finesse is required, a single sander can be employed.

The mounts, both fixed and movable, utilize spaced apart parallel resilient downwardly-extending arms to between which the sander is placed. When a sander is inserted within the arms, the arms are resiliently deformed and exert a biasing force against the sander that helps hold it in place. To further secure the sander, a strap is provided to encircle the sander and the arms and further secure the sander to the apparatus. The resilient nature of the arms permits each sander, such as when two are used, to flex independently of each other which helps accommodate unevenness of a flooring surface as might be expected in outdoor decking.

The mounts extend downwardly from a rectangular base having raised sidewalls on its top side forming a tray. Optionally, weights can be placed in the tray Terminology The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, upper, lower, vertical, horizontal, back, front and lateral are relative to each other and are dependent on the specific orientation of an applicable element or article, and are used accordingly to aid in the description of the various embodiments and are not necessarily intended to be construed as limiting.

The term "broom handle" is used generically herein to refer to an elongated rod or shaft used to operate and control the one or more sanders from a standing position.

An Embodiment of an Apparatus for Mounting One or Two Orbital Sanders

Figure 2:
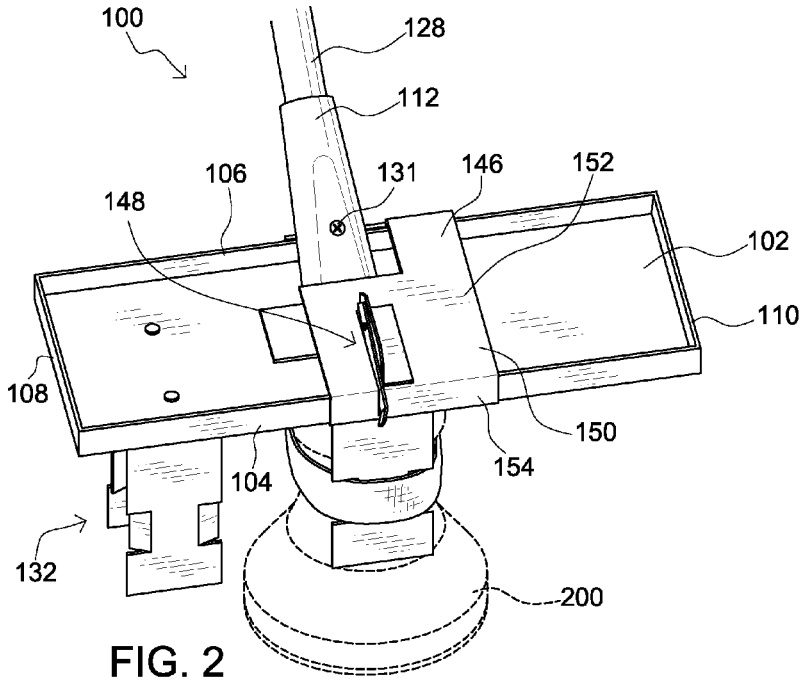
FIG. 2 is an isometric front/top view of the mounting apparatus with a single orbital sander attached thereto according to the embodiment of the present invention.
Figure 3:
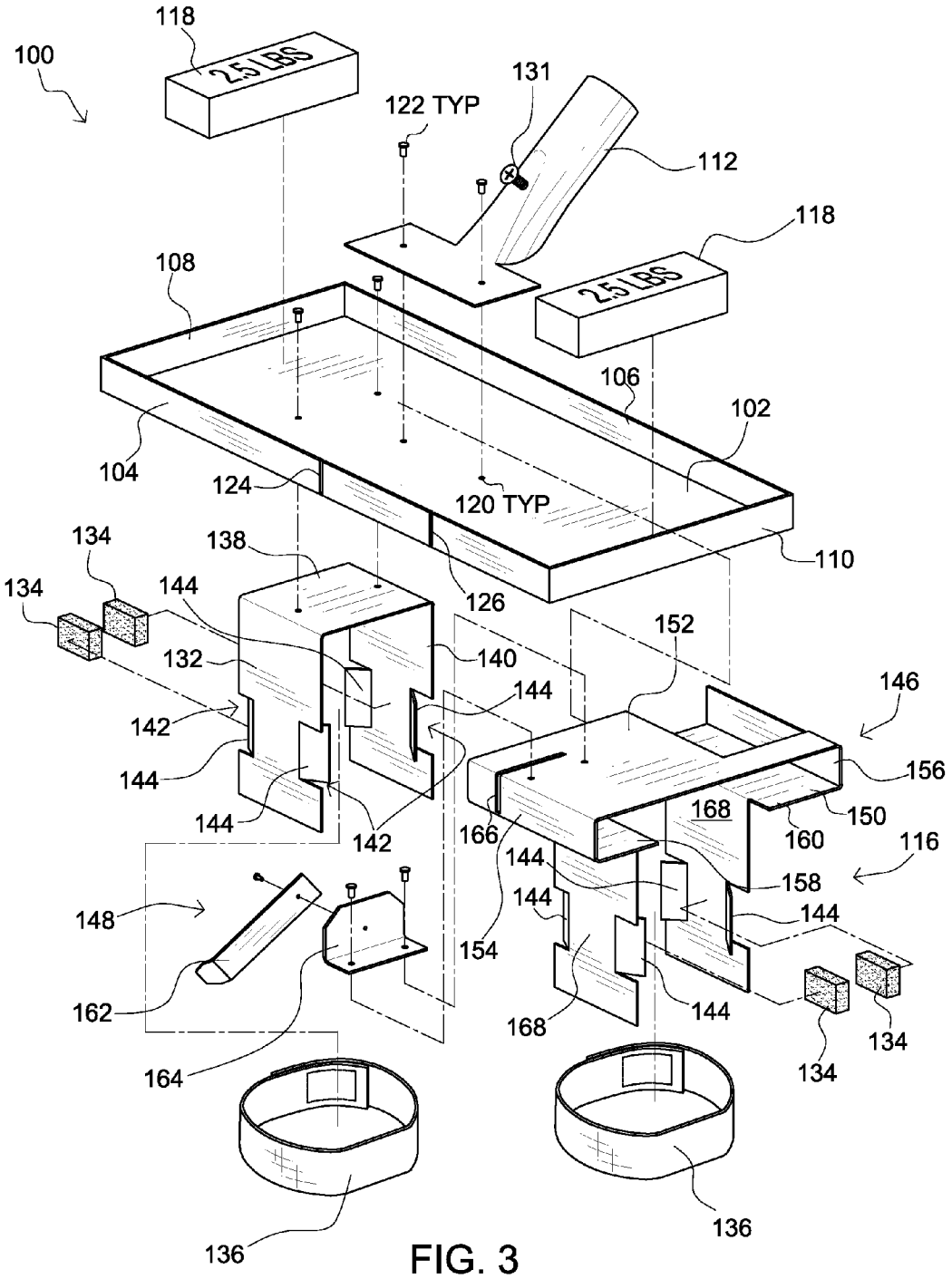
FIG. 3 is an isometric exploded view of the mounting apparatus according to the embodiment of the present invention
Figure 4:
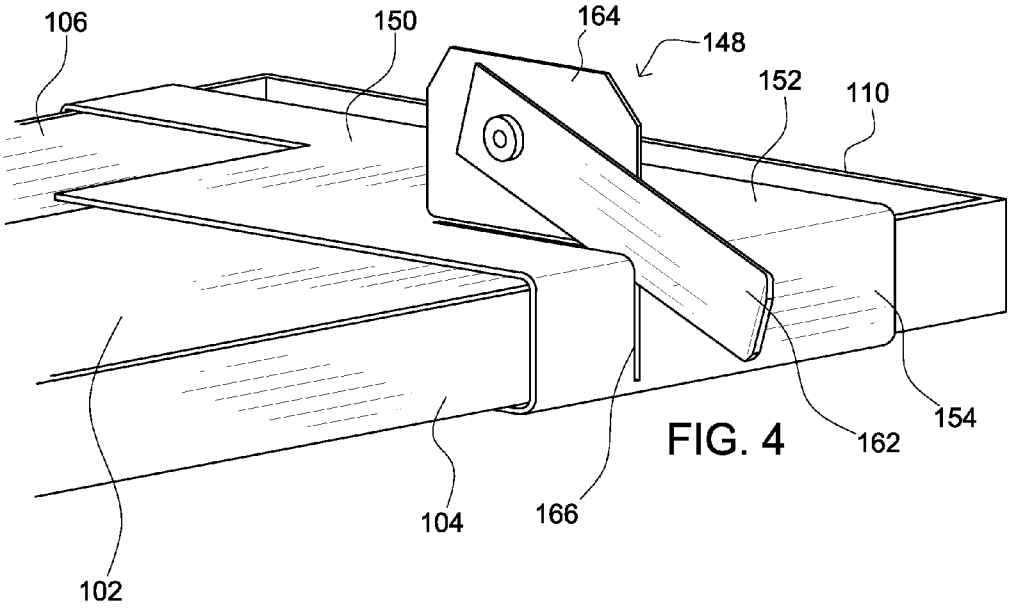
FIG. 4 is an isometric partial front view of the mounting apparatus illustrating the latching mechanism of the sliding mount according to one embodiment of the present invention.
Figure 5:
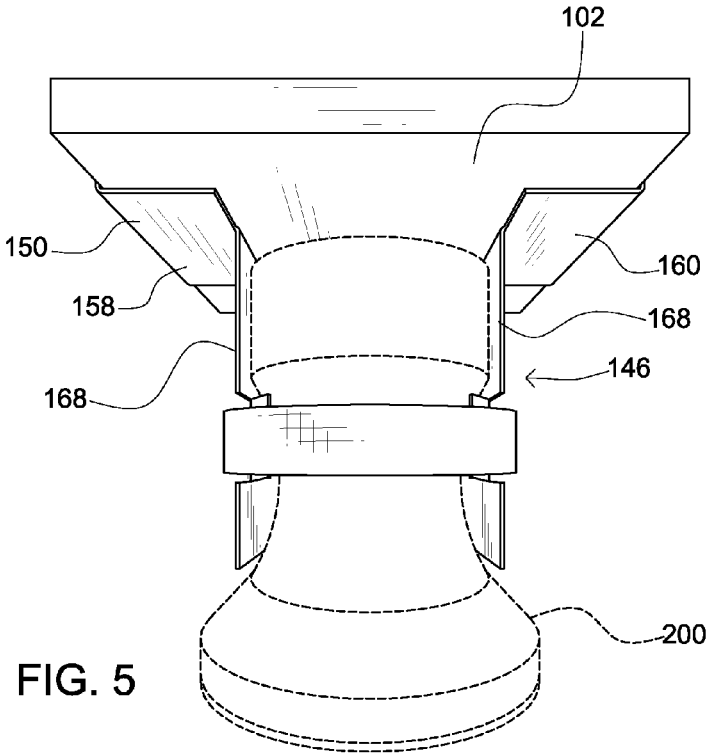
FIG. 5 is an isometric partial side/bottom view of the mounting apparatus illustrating the lower portion of the sliding mount located below the bottom side of the base with a sander mounted therein according to one embodiment of the present invention.
Figure 6:
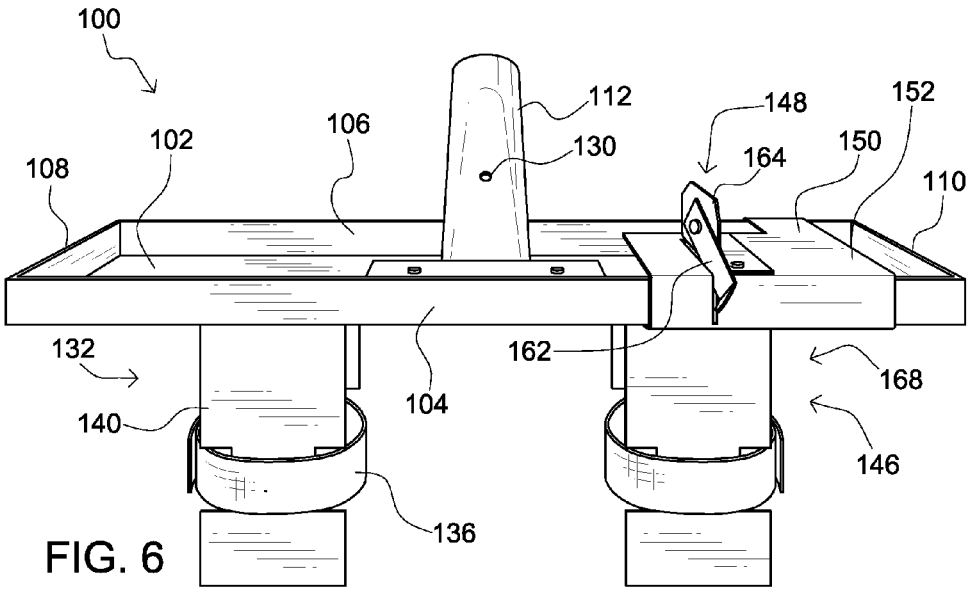
FIG. 6 is an isometric front view of the mounting apparatus sans the extension pole with the sliding mount located in a first position to facilitate the mounting of two sanders to the apparatus according to the embodiment of the present invention.
Figure 7:
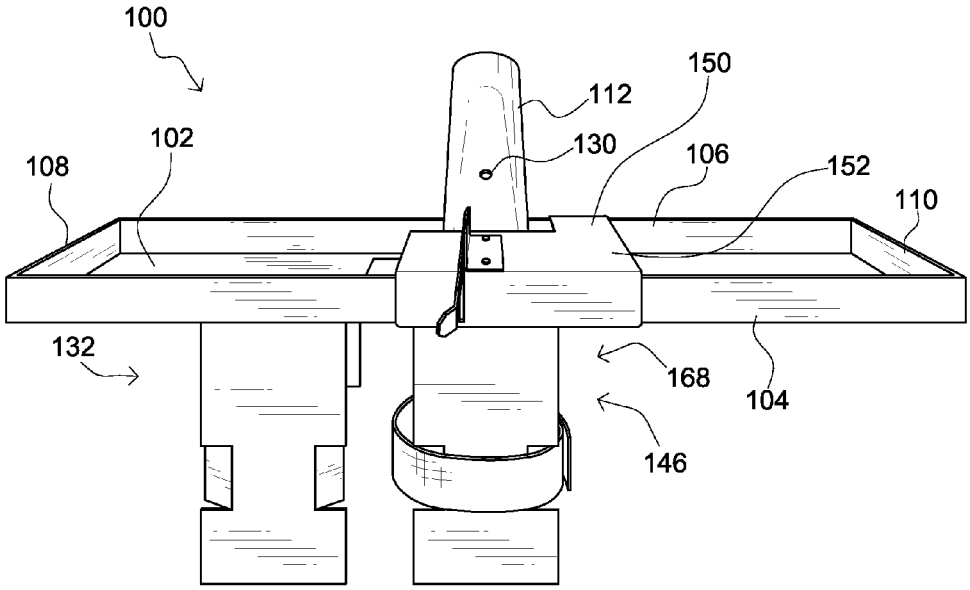
FIG. 7 is an isometric front view of the mounting apparatus sans the extension pole with the sliding mount located in a second position to facilitate the mounting of a single sander to the apparatus according to the embodiment of the present invention.

The sander mounting apparatus as shown in FIGS. 1-7 is configured to receive and operatively hold one or two orbital sanders on a bottom side and attach with a broom handle or other elongated rod on a top side thereby permitting a user to sand a deck or wood floor while standing. As shown with specific reference to FIG. 3, the mounting apparatus 100 comprises: (1) a rectangular base 102 having upwardly extending sidewalls 104-110 along its perimeter; (2) a shaft mount 112 fixedly attached to the top side of the base proximate its back end; (3) a fixed sander mount assembly 114 secured to the bottom of the base to the left of the shaft mount; and (4) a sliding mount assembly 116 configured to slide along the front and rear base sidewalls 104 & 106 between first and second positions to the right of the shaft mount. Optionally, one or more weights 118 can be provided that removably rest on the base to provide additional downward pressure during a sanding operation. In some variations, the top surface of the base and the bottom surfaces of the weights may include hook and loop material attached to the respective surfaces to help secure the weights on the base.

In the illustrated embodiment the base 102 is typically comprised galvanized sheet steel wherein the front, back, left and right sides 104-110 have been bent upwardly to form a tray. The sidewalls serve several purposes: (1) they act to contain any optional weights 118 received in the tray; (2) they impart rigidity and structural integrity to the base; (3) the front and back sidewalls act as rails for the sliding mount assembly 116. Various mounting holes 120 are provided through the base to receive rivets 122 or other fasteners used to secure the fixed mounting assembly 114 and the shaft mount 112 thereto. Further, first and second slots 124 & 126 are provided on the front sidewall for securing the sliding mount in its respective first and second positions.

The shaft mount 112 of the illustrated embodiment is also formed from a single sheet of galvanized steel and includes both a flat portion and a generally cylindrical portion. The flat portion includes a pair of fastening holes 120 thereon that align with similar fastening holes 120 on the base through which rivets 122 or other suitable fasteners are used to join the two pieces. The cylindrical portion is sized to receive a standard sized broom handle 128 therein. A screw hole 130 is provide through the cylindrical portion through which a screw 131 can be inserted and secured into the broom handle to hold it firmly in place.

As can be appreciated, the base and shaft mount can also be made of other suitable materials and by other means than formed sheet metal. In one variation, the entire base and shaft mount can be molded from a single or multiple plastic pieces and have a considerably different look than the illustrated embodiment. In variations fabricated as more than one piece, features as would be obvious to one of ordinary skill in the art, can be molded into the pieces to permit that to interface and join together. Further, receptacles can be molded into the base to specifically hold and secure optional weights.

In the illustrated embodiment, the fixed sander mount assembly 114 is comprised of a U-shaped galvanized sheet steel fixed mount 132, a pair of foam pads 134 and a securing strap 136. The fixed mount includes a flat body 138 with several rivet holes corresponding to holes in the rectangular base 102. The fixed mount is fixedly attached to the bottom surface of the base with rivets or other suitable fasteners. Parallel legs 140 extend downwardly from the body. The spacing of the legs corresponds to the approximate diameter or width of a handheld orbital sander, which is received between the legs when mounted to the apparatus. In at least some variations, the spacing is slightly less than the diameter or width of the type of sander it is configured to receive such that the resiliency of the legs act to provide a biasing force to help hold the sander in place. In other variations, the spacing comprises a distance in which the legs can receive a number of sanders produced by various manufacturers. For instance, the spacing maybe the slightly greater than the diameter of Sander A, but slightly narrower than the diameter of Sander B, but with use of the securing strap 136 both can be properly secured to the mount assembly.

While the legs are made of sheet steel in the illustrated embodiment, embodiments where the fixed mount and/or its legs can made of other suitable materials are contemplated. For instance, plastic legs could be utilized. Plastic legs could also be molded to fit specific types of sanders providing a sander specific mount assembly. In variations also using a plastic base, attachment features can be provided that permit the mount assembly to be easily removed and replaced. Securing mechanisms, such as ratchet straps, can also be integrally molded into the legs. In yet other variations, the mount assembly or even the entire apparatus can be comprised of a mix of materials. For instance, the body of the fixed mount assembly and the apparatus base can be comprised of plastic, perhaps of the high impact variety, and include integrally molded mating attachment mechanisms and the legs of the mount assembly can be steel or aluminum.

Referring to the figures, about ⅔rds down from the intersection with the body generally proximate their distal ends, the legs include cutouts 142 that extend inwardly from each of the right and left sides of the leg. The cutaway appendages 144 are bent inwardly and form a guide for the strap in addition to providing additional support to help secure the sander to the fixed mount assembly. The foam pads 134 are adhesively secured to the facing back surfaces of legs in between the opposing cutouts on each leg. The resilient foam pads help cradle the sander and provide further support for the sander in the mount by compressing as necessary to ensure maximum contact between the fixed mount assembly and the sander.

The securing strap 136 as the name implies is used to secure the sander to the fixed mount generally and the legs specifically by being wrapped around the outside of the legs at the cutouts 142 as well as around the sander and tightened. In the illustrated embodiment straps utilizing a hook and loop type closure are utilized but other clasping and tightening mechanisms can be employed as well. For instance in some embodiments, ratchet type straps and closures can be used such as are often used on ski boots.

Because of the flexible and resilient nature of the legs and the forgiving nature of the securing straps, the mount assembly with a sander mounted therein retains a measure of give and compliance allowing the sander to adjust to minor variations in floor height and angle especially relative to a second sander if so equipped. Furthermore, the resiliency of the mount assembly yet high strength offered by the plate steel permits the apparatus to withstand a fair amount of impact and abuse during use without suffering damage or imparting damage to the sander.

The sliding mount assembly 116, which comprises (i) a sliding mount 146, (ii) a pair of foam pads 134, (iii) a securing strap 136 and (iv) a latching mechanism 148, is configured to slide along the right side of the base and be selectively secured into (i) the first slot 124 to fix the mount in the first position at the center of the base inline with the shaft mount for use of the apparatus with a single sander, or (ii) the second slot 126 to fix the mount in the second position on the right side of the base effectively the same distance from the shaft mount as the fixed mount is on the left side for use of the apparatus with dual sanders.

Like the base 102 and the fixed mount 132, the illustrated sliding mount 146 is typically fabricated from galvanized sheet steel, although similarly to the fixed mount, the sliding mount can be comprised of other suitable materials. The sliding mount is generally T-shaped with a body portion 150 configured slide over the base between the first and second positions. The body portion includes a horizontal planar top side 152, planar front and back sides 154 & 156 that extend downwardly at about 90 degree angles from the respective front and back edges of the top side, and planar front and back bottom sides 158 & 160 that extend inwardly from the bottom edges of the respective front and back sides normally thereto. The various sides of the body define a space having a width and height comparable to the base wherein the body fits over the base.

The latching mechanism 148 is provided on the top side of the sliding mount's body 150 and comprises a pivoting lever 162 and a lever mount 164. The lever is orientated vertically and can be pivoted between open and closed positions. In the open position, wherein the sliding mount is free to slide between the first and second positions, the lever is pivoted above the body. In the closed position, the lever is pivoted and received through a slot 166 in the front side and one of the first and second slots 124 & 126 of the base 102 depending on whether the sliding mount is located at the first or second position thereby locking the sliding mount assembly in place. The illustrated latching mechanism is comprised of galvanized sheet steel but in variations and other embodiments can be comprised of other materials. Further, different configurations and types of latching mechanisms can be substituted for a latch as would be obvious to someone of ordinary skill in the art to which this invention pertains given the benefit of this disclosure.

Spaced apart parallel legs 168 extend downwardly from the inside edges of the left and right bottom sides. The legs, the foam pads 134 and strap 136 are substantially similar to the legs, foam pads and strap described above for the fixed mount assembly 114 and are used in substantially the same manner to secure a sander.

Configuring and Using an Embodiment of the Apparatus with One Orbital Sander

To configure the Apparatus 100 for use with a single sander 200, the sliding mount assembly 116 is placed in the first position. This is accomplished by moving the lever 162 of the latching mechanism 148 into its open position, which frees the sliding mount to slide along the right side of the base 102. The sliding mount assembly is then slid to the left until the slot in the mount's body 150 is aligned with the first slot 124 in the base. Once in place, the lever is pivoted into its closed position thereby locking the sliding mount assembly in place. In the first position, the sliding mount is aligned with the shaft mount 112 and any elongated handle 128 received in the shaft mount. Although movement of the sliding mount assembly may be easier without the sander installed therein, the mount can be moved between the first and second positions with the sander received therein as well.

To mount the sander 200 in the sliding mount assembly 116, the sander is slid between and centered in the sliding mount's legs 168. As necessary the legs may need to be splayed slightly while inserting the sander therein if the width of the sander is greater than the spacing between the legs. Vertically, the sander is positioned so that the strap 136 can be most securely fastened around the sander. With some sanders, the top of the sander may be inserted so that contact between the top of the sander and the bottom surface of the base is made. In other variations, the sander may be positioned at a location wherein the strap can best secure the sander, such as a location where the diameter of a sander necks down a little bit. After positioning the sander between the legs, the securing strap 136 is tightened around the legs and the sander.

To use the apparatus with the sander installed, a suitable abrasive disk is placed on the sander, the sander is plugged in and turned on and the user moves the sander over the flooring surface using the elongated handle while standing. If additional downward pressure is required to increase the aggressiveness of the sanding operation, one or more weights can be placed in the tray formed on the base. In one variation, a total of five pounds of weights have proven effective.

Configuring and Using an Embodiment of the Apparatus with Two Orbital Sanders

To configure the Apparatus 100 for use with dual sanders 200, the sliding mount assembly 116 is placed in the second position. This is accomplished by moving the lever 162 of the latching mechanism 148 into its open position, which frees the sliding mount to slide along the right side of the base 102. The sliding mount assembly is then slid to the right until the slot 166 in the mount's body 150 is aligned with the second slot 126 in the base. Once in place, the lever is pivoted into its closed position thereby locking the sliding mount assembly in place. In the second position, the sliding mount is essentially positioned on the right side of the base an equal distance from the shaft mount 112 as the fixed mount assembly 114 is on the left side of the base.

Sanders are mounted into each of the mount assemblies 114 & 116 in same manner as described above. Further except for having to attach a suitable abrasive pad to each sander and plug in and turn on each sander, the use and operation of the dual sander and apparatus combination is identical to the single sander combination.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. For instance, the exact design and configuration of the apparatus can vary dramatically from the illustrated embodiment utilizing different materials and mechanisms as best adapted for the materials and construction of the apparatus.

Embodiments are also calculated that are not convertible. For instance a single sander capable apparatus and a dual sander capable apparatus are contemplated wherein associated mounting assemblies are fixed and not adjustable. In other variations, additional features can be added. An embodiment that includes outlets for plugging in the sanders is contemplated. The outlets can be coupled to single cord that can be plugged into a wall directly or plugged into an extension cord. An on/off switch can be wired into the single cord and placed in a convenient location such as near the top of the elongated handle.

I claim:

1. A sander mounting apparatus configured to selectively secure a broom handle and one or two handheld orbital sanders thereto, the apparatus including:

a base, the base having a length and a width defining a lateral center axis;

a shaft mount attached to the base, the shaft mount being adapted to receive and secure the broom handle therein;

a first sander mount attached to the base at on a first side of the lateral center axis, the first sander mount being adapted to receive and secure a first handheld orbital sander of the one or two handheld orbital sanders therein; and a second sander mount slidably attached to the base, the second sander mount being adapted to receive and secure a second handheld orbital sander of the one or two handheld orbital sanders therein;

wherein the second sander mount is slidable relative to the first sander mount between (i) a first position substantially centered along a lateral center axis of the base, and (ii) a second position to a second side of the lateral center axis permitting two handheld orbital sanders to be mounted to the apparatus without interference, the second side being opposite the first side relative to the lateral center axis.

2. The sander mounting apparatus of claim 1, further comprising the broom handle, the broom handle being received and secured in the shaft mount.

3. The sander mounting apparatus of claim 1, wherein the base, the shaft mount, the first sander mount and the second sander mount are substantially comprised of formed sheet metal.

4. The sander mounting apparatus of claim 1, wherein the base is generally rectangular having left, right, front and rear edges, and top and bottom surfaces, the shaft mount being attached to the top surface centered along a lateral center axis of the base, the first sander mount attached to the bottom surface at a location between the lateral center axis and the left edge, the second position being at a location between the lateral center axis and the right edge.

5. The sander mounting apparatus of claim 1, wherein the first sander mount is fixed relative to the base.

6. The sander mounting apparatus of claim, wherein 4, wherein the base includes sides extending upwardly from the respective left, right, front and rear edges to form a tray.

7. The sander mounting apparatus of claim 6, further comprising one or more weights, the weights being removeably received in the tray.

8. The sander mounting apparatus of claim 1, wherein each of the first and second sander mount each includes spaced apart, generally parallel first and second resilient legs.

9. The sander mounting apparatus of claim 8, wherein (i) each of the first and second resilient legs includes inside and outside surfaces, and (ii) the inside surface of each has a foam pad secured thereto.

10. The sander mounting apparatus of claim 9, wherein each of the first and second sander mounts further include a strap, the strap configured for receipt around the first and second resilient arms to secure the respective first or second handheld orbital sander in place when the handheld orbital sander is received between the legs.

11. A combination comprising the sander mounting apparatus of claim 1, the first handheld orbital sander received and secured in the first sander mount, the second handheld orbital sander received and secured in the second sander mount, the broom handle being received in the shaft mount.

12. A combination comprising the sander mounting apparatus of claim 8, the first handheld orbital sander received and secured in the first sander mount, the second handheld orbital sander received and secured in the second sander mount, the broom handle being received in the shaft mount.

13. The sander mounting apparatus of claim 1, wherein the second sander mount further includes a latch, the latch being operative to secure the second sander mount in either the first or second positions when actuated, and permit the second sander mount to move when unactuated.

14. A method of sanding a floor using the sander mounting apparatus of claim 13, the method comprising:

providing the sander mounting apparatus;

securing the first handheld orbital sander in the first sander mount;

securing the second handheld orbital sander in the second sander mount;

attaching abrasive media to each of the handheld orbital sander and the other handheld orbital sander;

securing the broom handle in the shaft mount;

plugging each handheld orbital sander into an electrical socket;

turning on each handheld orbital sander;

placing the abrasive media of each handheld orbital sander as secured to the sander mounting apparatus in contact with a flooring surface to be sanded;

while standing and holding the broom handle sanding the flooring surface by moving the handheld orbital sanders across the flooring surface.

15. The method of claim 14, further comprising:

turning off the first and second handheld orbital sander;

removing the first handheld orbital sander from the first sander mount;

moving the latch of the second sander mount from an actuated position to an unactuated position;

moving the second sander mount from the second position to a first position, wherein the second sander mount and the second handheld orbital sander is substantially centered along the lateral center axis of the base;

moving the latch of the second sander mount from the unactuated position to the actuated position to secure the second sander mount in the first position;

plugging the second handheld orbital sander into an electrical socket;

turning on the second handheld orbital sander; and placing the abrasive media of the second handheld orbital sander as secured to the sander mounting apparatus in contact with the flooring surface to be sanded;

while standing and holding the broom handle sanding the flooring surface by moving the second handheld orbital sander across the flooring surface.

16. A sander mounting apparatus configured to selectively secure a broom handle and one or two handheld orbital sanders thereto, the apparatus including:

a base;

a shaft mount attached to the base, the shaft mount being adapted to receive and secure the broom handle therein;

a first sander mount attached to the base, the first sander mount being adapted to receive and secure a first handheld orbital sander of the one or two handheld orbital sanders therein; and a second sander mount movably attached to the base, the second sander mount being adapted to receive and secure a second handheld orbital sander of the one or two handheld orbital sanders therein;

wherein the base is generally rectangular having left, right, front and rear edges, and top and bottom surfaces, the shaft mount being attached to the top surface centered along a lateral center axis of the base, the first sander mount attached to the bottom surface at a location between the lateral center axis and the left edge, the second sander mount attached to the bottom surface at a location along the lateral center axis edge to between the lateral center axis and the right edge; and wherein the second sander mount is movable between a first position substantially centered along the lateral center axis of the base, and a second position to the right of the center lateral axis.

17. The sander mounting apparatus of claim 16, wherein the first sander mount is fixed relative to the base.

18. A sander mounting apparatus configured to selectively secure a broom handle and one or two handheld orbital sanders thereto, the apparatus including:

a base, the base being generally rectangular having left, right, front and rear edges, and top and bottom surfaces;

a shaft mount attached to the top surface centered along a lateral center axis of the base, the shaft mount being adapted to receive and secure the broom handle therein;

a first sander mount attached to the bottom surface at a location between the lateral center axis and the left edge, the first sander mount being adapted to receive and secure a first handheld orbital sander of the one or two handheld orbital sanders therein; and a second sander mount movably attached to the base, the second sander mount being movable between a first position substantially centered along the lateral center axis of the base, and a second position to the right of the center lateral axis, the second sander mount being adapted to receive and secure a second handheld orbital sander of the one or two handheld orbital sanders therein.

19. The sander mounting apparatus of claim 18, wherein the base, the shaft mount, the first sander mount and the second sander mount are substantially comprised of formed sheet metal.

* * * * *